US005783540A

United States Patent [19]

Secemski et al.

[11] Patent Number: 5,783,540

[45] Date of Patent: Jul. 21, 1998

[54] MACHINE DISHWASHING TABLETS DELIVERING A RINSE AID BENEFIT

[75] Inventors: Isaac Israel Secemski, Teaneck, N.J.; David John Lang, Ossining, N.Y.; John Richard Nicholson, Ramsey; Bozena Marianna Piatek, Cedar Grove, both of N.J.

[73] Assignee: Lever Brothers Company, Division of Conopco, Inc., New York, N.Y.

[21] Appl. No.: 780,061

[22] Filed: Dec. 23, 1996

[51] Int. Cl.[6] ..... C11D 17/00; C11D 3/39

[52] U.S. Cl. ..... 510/224; 510/226; 510/227; 510/228; 510/229; 510/230; 510/231; 510/232; 510/233; 510/374; 510/375; 510/377

[58] Field of Search ..... 510/224, 225, 510/375, 226, 227, 228, 229, 230, 231, 232, 233, 374, 377

[56] References Cited

U.S. PATENT DOCUMENTS

| | | | |
|---|---|---|---|
| 4,144,226 | 3/1979 | Crutchfield et al. | 525/401 |
| 4,146,495 | 3/1979 | Crutchfield et al. | 510/476 |
| 4,219,435 | 8/1980 | Biard et al. | 510/224 |
| 4,219,436 | 8/1980 | Gromer et al. | 510/224 |
| 4,569,780 | 2/1986 | Fernholz et al. | 510/225 |
| 4,587,031 | 5/1986 | Kruse et al. | 510/224 |
| 4,686,062 | 8/1987 | Kermode et al. | 510/315 |
| 4,828,749 | 5/1989 | Kruse et al. | 510/224 |
| 4,839,078 | 6/1989 | Kruse et al. | 510/224 |
| 4,897,212 | 1/1990 | Kruse et al. | 510/224 |
| 5,114,606 | 5/1992 | Van Vliet et al. | 8/111 |
| 5,114,611 | 5/1992 | Van Kralingen et al. | 510/311 |
| 5,133,892 | 7/1992 | Chun et al. | 510/224 |
| 5,200,236 | 4/1993 | Lang et al. | 510/222 |
| 5,318,713 | 6/1994 | Binter | 510/224 |
| 5,358,655 | 10/1994 | Kruse et al. | 510/224 |
| 5,453,216 | 9/1995 | Kellett | 510/224 |
| 5,480,577 | 1/1996 | Nicholson et al. | 510/372 |
| 5,482,641 | 1/1996 | Fleisher | 510/225 |
| 5,490,949 | 2/1996 | Backes et al. | 510/225 |
| 5,518,646 | 5/1996 | Van der Brom | 510/225 |
| 5,650,017 | 7/1997 | Gordon et al. | 510/224 |
| 5,670,467 | 9/1997 | Fleisher | 510/225 |

FOREIGN PATENT DOCUMENTS

| | | | |
|---|---|---|---|
| 94/22800 | 10/1994 | WIPO . | |
| 95/12657 | 5/1995 | WIPO . | |
| 97/03177 | 1/1997 | WIPO | 510/224 |

*Primary Examiner*—Anthony Green
*Attorney, Agent, or Firm*—A. Kate Huffman

[57] ABSTRACT

A solid detergent composition and a method of using the composition in a machine dishwasher is described. The product contains a first layer having an oxygen bleaching system, a buffering system of a builder, and an enzyme. The first layer dissolves to deliver a pH of about 8.5 to about 11 in the wash water. A second layer includes an effective amount of an acidity agent selected from an inorganic acid, an organic acid and mixtures thereof, a continuous medium having a melting point in the range of from about 55° C. to about 70° C. and an anti-scaling agent. The second layer dissolves in wash water to deliver a pH of from about 6.5 to about 9.

9 Claims, No Drawings

MACHINE DISHWASHING TABLETS DELIVERING A RINSE AID BENEFIT

FIELD OF THE INVENTION

The invention relates to machine dishwashing compositions in solid tablet form that deliver excellent overall performance by virtue of controlled release of functional ingredients into the rinse cycle.

BACKGROUND OF THE INVENTION

The share of machine dishwashing tablets in certain markets has grown significantly in recent years primarily because they are perceived to be more convenient than alternative product forms such as powders. However, the product form and method of delivery of tablets can limit both the type of functional ingredients incorporated and the level of functionality from these ingredients.

A complication unique to tablets derives from the method of introduction into the machine. Thus, some tablets are designed to be placed directly into the machine itself, such as in a basket hanging from the upper rack, where they come into contact with a water spray as soon as the machine starts, while others are delivered via the dispenser and are only released during the main wash cycle. Clearly, the release and performance of functional ingredients will differ depending on how the tablet is delivered.

Each type of delivery has potential weaknesses. Thus, for tablets that come into immediate contact with the water spray, some of the functional ingredients can be released into the pre-wash where, if the temperature is too low the ingredients will be lost without delivering a significant benefit. For both types of tablets, complete dissolution may not occur during the main wash cycle. If part of the tablet is still available for dissolution in the rinse, serious spotting and filming problems can occur. These potential negatives are specific to the tablet form. Liquids or powders are introduced into the wash via the dispensing cup and so there are no losses during the pre-wash and the rapid rate of dissolution of these products ensures no carry over of undissolved product into the rinse.

In summary, the tablet forms impose some restrictions on delivery of functional ingredients into the wash which must be overcome in order to obtain acceptable overall performance. Nevertheless, the tablet also offers some unique opportunities by virtue of its physical form and dissolution profile. As an example, failure of a tablet to fully dissolve in the main wash is generally a negative since it can result in high levels of spotting and filming if certain ingredients are available for dissolution in the final rinse. However, certain ingredients can offer an advantage if released into the rinse cycle rather than in the main wash and tablets provide a viable route to achieving this. Examples of ingredients that function effectively in the rinse are sources of acidity that can aid in diminishing spotting and filming, anti-scalants to prevent scale build-up and surfactants to deliver a sheeting action that results in spotless glasses. These ingredients are often present in rinse aids that are separately dosed from a dedicated dispenser in the machine. If the benefits of these rinse aid functional ingredients can be delivered from a main wash product, such as a tablet, this offers a clear advantage for the consumer in terms of convenience.

Currently, there is no effective way of consistently delivering a rinse aid benefit from a main wash product. Under rare conditions of light soiling, low water hardness and a minimum of pre-rinses prior to the final rinse, a small rinse aid benefit can be obtained from carry-over of a small amount of surfactant into the final rinse. However, these benefits are small compared to a traditional rinse aid and are delivered very infrequently.

In the prior art, delaying release of an acid source for improved spotting and filming is described in WO 95/12657. However, this application relates only to powder or granular compositions and not to tablets. The publication describes the use of poorly soluble coatings and of modifying the physical characteristics of the acid to control its solubility and rate of release. In addition, the methods described in WO 95/12657 are not feasible for delivering functional ingredients into the rinse because ingredients from a powder formulation will be drained from the machine along with the wash water prior to the rinse cycle.

U.S. Pat. No. 5,453,216 describes a delayed release composite particle containing a core and an encapsulating coating which has a melting point above 65° C. The mechanism of release is not melting of the coating but saponification of the insouble coating at high pH. With this form of product and release mechanism, the ingredient that delivers the rinse aid benefit is not released in the rinse cycle. Firstly, since the particle requires a high pH to release the ingredients of the core, the release will occur in a high pH main wash, not in a low pH rinse cycle. In addition, the particle described in the patent will be flushed out of the machine with the main wash water and will not be carried over into the final rinse.

U.S. Pat. No. 5,133,892 describes a tablet containing an outer layer and an inner core with a barrier layer separating the outer layer from the inner core. It is suggested that this type of tablet is useful for incorporating both chlorine bleach and enzymes into a single tablet. Thus, in a machine cycle, the outer layer will dissolve first and the barrier layer will slow down the dissolution of the inner layer, which is a core totally surrounded by the barrier layer. It also suggests that a rinse aid can be incorporated into the inner core layer and released during the appropriate time in the wash cycle. However, Chun et al. fails to address a number of key issues relating to the claimed benefit of delivering a rinse aid benefit. Processing of the tablets, as described in the patent, is not a viable proposition for a machine dishwashing product involving a complicated ten-stage process including intricate steps of placing cores within dies. In addition, the patent does not address the problem, well known to those skilled in the art, of splitting off of various layers of such tablets during the wash, rather than steady dissolution from the outer layer to the inner core layer. Thus, there is little control of when the ingredients are actually released during the cycle. In addition, the patent does not adequately describe how the barrier layer controls the release of ingredients from the inner core such that they are released at the appropriate time during the wash cycle. Finally, the tablet described does not release the rinse aid additive into the final rinse. If it operates as described, it will be released at some time during a main wash cycle.

Thus, it is the object of the present invention to provide an inventive tablet form to effectively deliver ingredients into the wash to ensure an excellent finish on articles in the dishwasher. In particular, the delivery of specific ingredients, especially a source of acidity, anti-scaling agents and surfactant, are delayed until the rinse position of the wash cycle.

Another object of the invention is to provide tablets which are more aesthetically pleasing than tablets made with current technology and which are more consumer-friendly with a virtual absence of fines on the tablet surface.

SUMMARY OF THE INVENTION

The present invention relates to tablets for use in machine dishwashing and warewashing applications that have good handling characteristics and excellent cleaning performance by virtue of controlled release, specifically controlled release of ingredients into the rinse cycle that deliver an excellent finish to articles, especially glasses, that is normally only obtained with a separate rinse aid. These ingredients include a source of acidity and, optionally, anti-scaling agents and low foaming surfactants. The tablets have at least two layers, the exact number of layers depending on the manner in which the main wash ingredients are to be delivered. The first layer of a two-layer tablet incorporates a builder, at least one enzyme, a bleaching system, a buffering system and, optionally, surfactant, anti-corrosion agents, silver anti-tarnish agents, anti-redeposition agent, sequestrants, anti-scalants, a processing aid to allow a high strength tablet to be processed under low compaction pressures, a disintegrant to aid in tablet dissolution and a lubricant to aid processing.

The second layer of a two-layer tablet consists of a source of acidity and, optionally, anti-scaling agents and a low foaming surfactant incorporated into a continuous medium that has a minimum melting point of about 55° C. and a maximum melting point of about 70° C. The source of acidity and the anti-scaling agent can be incorporated into the continuous layer either as is or as a pre-formed granulate. The granulate can optionally contain a suitable surfactant to enhance dissolution. The release profile of ingredients that deliver the main wash functionality from the first layer of a two-layer tablet are such that substantially none of the ingredients are carried over into the final rinse. In contrast, the melting point of the second layer is such that it will survive the majority of main wash cycles but will melt/disperse in the high temperature final rinse to release functional ingredients that deliver a good finish benefit to the articles, especially glass articles.

DETAILED DESCRIPTION OF THE PREFERRED EMBODIMENTS

The compositions of the invention may be in any conventional solid form, but are preferably in the form of a tablet having at least two layers and useful in machine dishwashing and warewashing applications.

First Layer

The first layer of a two-layer tablet comprises from about 5 wt. % to about 90 wt. % of a builder; an effective amount of at least one enzyme selected from the group consisting of a protease, an amylase and mixtures thereof, a buffering system to deliver a pH in the wash water of about 8.5 to about 11.0; an effective amount of an oxygen bleach system selected from the group consisting of a per acid, a per acid precursor plus a source of hydrogen peroxide, a source of hydrogen peroxide alone, a diacyl peroxide or mixtures thereof at a level of about 1 to about 25 wt. % with or without an organic or inorganic bleach catalyst which, if present, is at a level of about 0.0001 to about to 10 wt. %, preferably about 0.001 to about 5 wt. % of the composition. Optional ingredients may also be included.

Detergent Builder Materials

The compositions of this invention can contain all manner of detergent builders commonly taught for use in machine dishwashing or other cleaning compositions. The builders can include any of the conventional inorganic and organic water-soluble builder salts, or mixtures thereof and may comprise about 5 to about 90% by weight, preferably from about 10 to about 80% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, pyrophosphates and hexametaphosphates.

Suitable examples of non-phosphorus-containing inorganic builders, when present, include water-soluble alkali metal carbonates, bicarbonates, sesquicarbonates, borates, silicates, including layered silicates such as SKS-6 ex. Hoechst, metasilicates, and crystalline and amorphous aluminosilicates. Specific examples include sodium carbonate (with or without calcite seeds), potassium carbonate, sodium and potassium bicarbonates, silicates including layered silicates and zeolites.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starch es, oxidized heteropolymeric polysaccharides, polyhydroxysulfonates, polycarboxylates such as polyacrylates, polymaleates, polyacetates, polyhydroxyacrylates, polyacrylatelpolymaleate and polyacrylates polymethacrylate copolymers, acrylate/maleate/vinyl alcohol terpolymers, aminopolycarboxylates and polyacetal carboxylates, and polyaspartates and mixtures thereof. Such carboxylates are described in U.S. Pat. Nos. 4,144,226, 4,146,495 and 4,686,062.

Alkali metal citrates, nitrilotriacetates, oxydisuccinates, polyphosphonates, acrylate/maleate copolymers and acrylate/maleate/vinyl alcohol terpolymers are especially preferred organic builders.

The foregoing detergent builders are meant to illustrate but not limit the types of builders that can be employed in the present invention.

Enzymes

Enzymes capable of facilitating the removal of soils from a substrate may also be present in an amount of up to about 10% by wt., preferably 1 to about 5 wt. %. Such enzymes include proteases (e.g., Alcalase®, Savinase® and Esperase® from Novo Industries A/S and Purafect OxP®, ex. Genencor), amylases (e.g., Termamyl® and Duramyl® from Novo Industries and Purafect OxAm®, ex. Genencor).

Buffering System

The buffering system is present in the first layer to deliver a pH of about 8.5 to about 11 in the wash water. Materials which may be selected for the buffering system include water-soluble alkali metal carbonates, bicarbonates, sesquicarbonates, borates, silicates, layered silicates such as SKS-6 ex Hoechst, metasilicates, phytic acid, borate and crystalline and amorphous aluminosilicates and mixtures thereof. Preferred examples include sodium and potassium carbonate, sodium and potassium bicarbonates, borates and silicates, including layered silicates.

OXYGEN BLEACHING SYSTEMS

Peroxy Bleaching Agents

The oxygen bleaching agents of the compositions include organic peroxy acids and diacylperoxides. Typical monoperoxy acids useful herein include alkyl peroxy acids and aryl peroxy acids such as:

i) peroxybenzoic acid and ring-substituted peroxybenzoic acids, e.g., peroxy-alpha-naphthoic acid, and magnesium monoperoxyphthalate ii) aliphatic and substituted aliphatic monoperoxy acids, e.g., peroxylauric acid, peroxystearic acid, epsilon-phthalimido-peroxyhexanoic acid and o-carboxybenzamido peroxyhexanoic acid, N-nonylamidoperadipic acid and N-nonylamidopersuccinic acid.

iii) Cationic peroxyacids such as those described in U.S. Pat. Nos. 5,422,028, 5,294,362; and 5,292,447, Atty. Docket No. U.S. Ser. No. 08/738,504 Oakes et al.; and U.S. Ser. No. 08/210,973, Oakes et al., herein incorporated by reference.

iv) Sulfonyl peroxyacids such as compounds described in U.S. Pat. No. 5,039,447 (Monsanto Co.), herein incorporated by reference.

Typical diperoxy acids useful herein include alkyl diperoxy acids and aryl diperoxy acids, such as:

v) 1,12-diperoxydodecanedioic acid vi) 1,9-diperoxyazelaic acid vii) diperoxybrassylic acid; diperoxysecacic acid and diperoxy-isophthalic acid viii) 2-decyidiperoxybutan-1,4-dioic acid ix) $N,N^1$-terephthaloyl-di(6-aminopercaproic acid).

A typical diacylperoxide useful herein includes dibenzoylperoxide.

Inorganic peroxygen compounds are also suitable for the present invention. Examples of these materials useful in the invention are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The organic peroxy acid is present in the composition in an amount such that the level of organic peroxy acid in the wash solution is about 1 ppm to about 300 ppm AvOx, preferably about 2 ppm to about 200 ppm AvOx.

The oxygen bleaching agent may be incorporated directly into the formulation or may be encapsulated by any number of encapsulation techniques.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to 50° C. The wax coating has a thickness of from 100 to 1500 microns.

The most preferred method of incorporating a peroxy acid is via a separate layer as described in copending application, Nicholson et al.; U.S. Ser. No. 08/780,062.

Bleach Precursors

Suitable per acid precursors for peroxy bleach compounds have been amply described in the literature, including GB Nos. 836,988; 855,735; 907,356; 907;358; 907,950; 1,003,310 and 1,246,339; U.S. Pat. Nos. 3,332,882 and 4,128,494.

Typical examples of precursors are polyacylated alkylene diamines, such as N,N,N,'N'-tetraacetylethylene diamine (TAED) and N,N,N,'N'-tetraacetylmethylene diamine (TAMD); acylated glycolurils, such as tetraacetylglycoluril (TAGU); triacetylcyanurate, sodium sulfophenyl ethyl carbonic acid ester, sodium acetyloxybenene sulfonate (SABS), sodium nonanoyloxy benzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromophenylbenzoate; sodium or potassium benzoyloxy benzene-sulfonate; and benzoic anhydride.

Preferred peroxygen bleach precursors are sodium p-benzoyloxybenzene sulfonate, N,N,N,'N'-tetraacetylethylene diamine, sodium nonanoyloxybenzene sulfonate and choline sulfophenyl carbonate. The peroxygen bleach precursors are present in the composition in an amount from about 1 to about 20 wt. %, preferably from about 1 to about 15 wt. %, most preferably from about 2 to about 10 weight %. To deliver a functional peroxygen bleach from a precursor, a source of hydrogen peroxide is required. The hydrogen peroxide source is preferably a compound that delivers hydrogen peroxide on dissolution. Preferred sources of hydrogen peroxide are sodium perborate, either as mono- or tetrahydrate and sodium percarbonate. The source of hydrogen peroxide, when included in the composition, is present at a level from about 1% to about 30% by weight, preferably from about 2% to about 25% by weight, most preferably from about 4% to about 20% by weight.

Bleach Catalyst

An effective amount of a bleach catalyst can also be present in the first layer. A number of organic catalysts are available such as the sulfonimines as described in U.S. Pat. Nos. 5,041,232; 5,047,163 and 5,463,115.

Transition metal bleach catalysts are also useful especially those based on manganese, iron, cobalt, titanium, molybdenum, nickel, chromium, copper, ruthenium, tungsten and mixtures thereof. These include simple water-soluble salts such as those of iron, manganese and cobalt as well as catalysts containing complex ligands.

Suitable examples of manganese catalysts containing organic ligands are described in U.S. Pat. No. 4,728,455, U.S. Pat. No. 5,114,606, U.S. Pat No. 5,153,161, U.S. Pat. No. 5,194,416, U.S. Pat. No. 5,227,084, U.S. Pat. No. 5,244,594, U.S. Pat. No. 5,246,612, U.S. Pat. No. 5,246,621, U.S. Pat. No. 5,256,779, U.S. Pat. No. 5,274,147, U.S. Pat. No. 5,280,117 and European Pat. App. Pub. Nos. 544,440, 544,490, 549,271 and 549,272. Preferred examples of these catalysts include $Mn^{IV}{}_2(u\text{-}O)_2$(1,4,7-trimethyl-1,4,7-triazacyclononane)$_2(PF_6)_2$, $Mn^{III}{}_2(u\text{-}O)_1(u\text{-}OAc)_2$(1,4,7-trimethyl-1,4,7-triazacyclononane)$_2(ClO_4)_2$, $Mn^{IV}{}_4(u\text{-}O)_6$(1,4,7-triazacyclononane)$_4$ $(ClO_4)_4$, $Mn^{III}Mn^{IV}{}_4(u\text{-}O)_1(u\text{-}OAc)_2$(1,4,7-trimethyl-1,4,7triazacyclononane)$_2(ClO_4)_3$, $Mn^{IV}$(1,4,7-trimethyl-1,4,7-triazacyclononane)-$(OCH_3)_3$ $(PF_6)$, and mixtures thereof. Other metal-based bleach catalysts include those disclosed in U.S. Pat. No. 4,430,243 and U.S. Pat. No. 5,114,611.

Iron and manganese salts of aminocarboxylic acids in general are useful herein including iron and manganese aminocarboxylate salts disclosed for bleaching in the photographic color processing arts. A particularly useful transition metal salt is derived from ethylenediaminedisuccinate and any complex of this ligand with iron or manganese.

Another type of bleach catalyst, as disclosed in U.S. Pat. No. 5,114,606 is a water soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose and mixtures thereof. Especially preferred is sorbitol.

U.S. Pat. No. 5,114,611 teaches a bleach catalyst comprising a complex of transition metals, including manganese, cobalt, iron or copper with an non-(macro)-cyclic ligand. Other examples include Mn gluconate, $Mn(CF_3SO_3)_2$, and binuclear Mn complexed with tetra-N-dentate and bi-N-dentate ligands, including $[bipy_2Mn^{III}(u\text{-}O)_2Mn^{IV}bipy_2](ClO_4)_3$.

Other bleach catalysts are described, for example, in European Pat. No. App. Pub. Nos. 408,131 (cobalt complexes), 384,503 and 306,089 (metallo-porphyrins), U.S. Pat. No. 4,728,455 (manganese/multidenate ligand), U.S. Pat. No. 4,711,748 (absorbed manganese on aluminosilicate), U.S. Pat. No. 4,601,845 (aluminosilicate support with manganese, zinc or magnesium salt), U.S. Pat. No. 4,626,373 (manganese/ligand), U.S. Pat. No. 4,119,557 (ferric complex), U.S. Pat. No. 4,430,243 (Chelants with manganese cations and non-catalytic metal cations), and U.S. Pat. No. 4,728,455 (manganese gluconates).

Useful catalysts based on cobalt are described in Pat. App. Pub. Nos. WO 96/23859, WO 96/23860 and WO 96/23861 and U.S. Pat. No. 5,559,261. WO 96/23860 describe cobalt catalysts of the type $[Co_nL_mX_p]^ZY_z$, where L is an organic ligand molecule containing more than one heteroatom selected from N, P, O and S; X is a coordinating species; n is preferably 1 or 2; m is preferably 1 to 5; p is preferably 0 to 4 and Y is a counterion. One example of such a catalyst is N,N'-Bis (salicylidene)ethylenediaminecobalt(II). Other cobalt catalysts descibed in these applications are based on Co(III) complexes with ammonia and mon-, bi-, tri- and tetradentate ligands such as $[Co(NH_3)_5OAc]^{2+}$ with $Cl^-$, $OAc^-$, $PF_6^-$, $SO_4^=$, $BF_4^-$ anions.

Certain transition-metal containing bleach catalysts can be prepared in the situ by the reaction of a transition-metal salt with suitable chelating agent, for example, a mixture of manganese sulfate and ethylenediaminedisuccinate. Highly colored transition metal-containing bleach catalysts may be co-processed with zeolites to reduce the color impact.

When present, the bleach catalyst is typically incorporated at a level of about 0.0001 to about 10% by wt., preferably about 0.001 to about 5% by weight.

Optional First Layer Ingredients

Optionally a surfactant may be included in the first layer including anionic, nonionic, cationic, amphoteric, zwitterionic surfactants and mixtures of these surface active agents. Such surfactants are well known in the detergent arts and are described at length at "Surface Active Agents and Detergents", Vol. 2 by Schwartz, Perry and Birch, Interscience Publishers, Inc., 1959, herein incorporated by reference.

Preferred surfactants are one or a mixture of:

Anionic surfactants

Anionic synthetic detergents can be broadly described as surface active compounds with one or more negatively charged functional groups. An important class of anionic compounds are the water-soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Primary Alkyl Sulfates $$R^1OSO_3M$$

where $R^1$ is a primary alkyl group of 8 to 18 carbon atoms and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. The solubilizing cation may be a range of cations which are in general monovalent and confer water solubility. Alkali metal, notably sodium, is especially envisaged. Other possibilities are ammonium and substituted ammonium ions, such as trialkanolammonium or trialkylammonium.

Alkyl Ether Sulfates $$R^1O(CH_2CH_2O)_nSO_3M$$

where $R^1$ is a primary alkyl group of 8 to 18 carbon atoms, n has an average value in the range from 1 to 6 and M is a solubilizing cation. The alkyl group $R^1$ may have a mixture of chain lengths. It is preferred that at least two thirds of the $R^1$ alkyl groups have a chain length of 8 to 14 carbon atoms. This will be the case if $R^1$ is coconut alkyl, for example. Preferably n has an average value of 2 to 5.

Fatty Acid Ester Sulfonates $$R^2CH(SO_3M)CO_2R^3$$

where $R^2$ is an alkyl group of 6 to 16 atoms, $R^3$ is an alkyl group of 1 to 4 carbon atoms and M is a solubilizing cation. The group $R^2$ may have a mixture of chain lengths. Preferably at least two thirds of these groups have 6 to 12 carbon atoms. This will be the case when the moiety $R^2CH(-)CO_2(-)$ is derived from a coconut source, for instance. It is preferred that $R^3$ is a straight chain alkyl, notably methyl or ethyl.

Alkyl Benzene Sulfonates ti $R^4ArSO_3M$ where $R^4$ is an alkyl group of 8 to 18 carbon atoms, Ar is a benzene ring ($C_6H_4$) and M is a solubilizing cation. The group $R^4$ may be a mixture of chain lengths. Straight chains of 11 to 14 carbon atoms are preferred.

Paraffin sulfonates having 8 to 22 carbon atoms, preferably 12 to 16 carbon atoms, in the alkyl moiety. These surfactants are commercially available as Hostapur SAS from Hoechst Celanese.

Olefin sulfonates having 8 to 22 carbon atoms, preferably 12 to 16 carbon atoms. U.S. Pat. No. 3,332,880 contains a description of suitable olefin sulfonates.

Organic phosphate based anionic surfactants include organic phosphate esters such as complex mono- or diester phosphates of hydroxyl- terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Particularly preferred anionic surfactants are the fatty acid ester sulfonates with formula:

$$R^2CH(SO_3M)CO_2R^3$$

where the moiety $R^2CH(-)CO_2(-)$ is derived from a coconut source and $R^3$ is either methyl or ethyl; primary alkyl sulfates with the formula:

$$R^1OSO_3M$$

wherein $R^1$ is a primary alkyl group of 10 to 18 carbon atoms and M is a sodium cation; and paraffin sulfonates, preferably with 12 to 16 carbon atoms to the alkyl moiety.

Nonionic Surfactants

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

polyoxyalkene condensates of aliphatic carboxylic acids, whether linear- or branched-chain and unsaturated or saturated, especially ethoxylated and/or propoxylated aliphatic acids containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, polyoxyalkene condensates of aliphatic alcohols, whether linear- or branched-chain and unsaturated or saturated, especially ethoxylated and/or propoxylated aliphatic alcohols containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol.

Ethoxylated fatty alcohols may be used alone or in admixture with anionic surfactants, especially the preferred surfactants above. The average chain lengths of the alkyl group $R^5$ in the general formula:

$$R^5O(CH_2CH_2O)_nH$$

is from 6 to 20 carbon atoms. Notably the group $R^5$ may have chain lengths in a range from 9 to 18 carbon atoms.

The average value of n should be at least 2. The numbers of ethylene oxide residues may be a statistical distribution around the average value. However, as is known, the distribution can be affected by the manufacturing process or altered by fractionation after ethoxylation. Particularly preferred ethoxylated fatty alcohols have a group $R^5$ which has 9 to 18 carbon atoms while n is from 2 to 8.

Also included within this category are nonionic surfactants having a formula:

$$R^6-(CH_2\underset{\underset{R^7}{|}}{C}HO)_x(CH_2CH_2O)_y(CH_2\underset{\underset{R^8}{|}}{C}HO)_zH$$

wherein $R^6$ is a linear alkyl hydrocarbon radical having an average of 6 to 18 carbon atoms, $R^7$ and $R^8$ are each linear alkyl hydrocarbons of about 1 to about 4 carbon atoms, x is an integer of from 1 to 6, y is an integer of from 4 to 20 and z is an integer from 4 to 25.

One preferred nonionic surfactant of the above formula is Poly-Tergent SLF-18® a registered trademark of the Olin Corporation, New Haven, Conn. having a composition of the above formula where $R^6$ is a $C_6$–$C_{10}$ linear alkyl mixture, $R^7$ and $R^8$ are methyl, x averages 3, y averages 12 and z averages 16. Another preferred nonionic surfactant is $$R^9O(CH_2\underset{\underset{CH_3}{|}}{C}HO)_j(CH_2CH_2O)_k(CH_2CH(OH)R^{10})_l$$

wherein $R^9$ is a linear, aliphatic hydrocarbon radical having from about 4 to about 18 carbon atoms including mixtures thereof; and $R^{10}$ is a linear, aliphatic hydrocarbon radical having from about 2 to about 26 carbon atoms including mixtures thereof; j is an integer having a value of from 1 to about 3; k is an integer having a value from 5 to about 30; and z is an integer having a value of from 1 to about 3. Most preferred are compositons in which j is 1, k is from about 10 to about 20 and l is 1. These surfactants are described in WO 94/22800. Other preferred nonionic surfactants are linear fatty alcohol alkoxylates with a capped terminal group, as described in U.S. Pat. No. 4,340,766 to BASF. Particularly preferred is Plurafac LF403 ex. BASF.

Another nonionic surfactant included within this category are compounds of formula:

$$R^{11}-(CH_2CH_2O)_qH$$

wherein $R^{11}$is a $C_6$–$C_{24}$ linear or branched alkyl hydrocarbon radical and q is a number from 2 to 50; more preferably $R^{11}$ is a $C_8$–$C_{18}$ linear alkyl mixture and q is a number from 2 to 15.

polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbital tristearate, sorbitan monooleate, and sorbitan trioleate. The polyoxyethylene chains may contain between about 4 and 30 ethylene oxide units, preferably about 10 to 20. The sorbitan ester derivatives contain 1, 2 or 3 polyoxyethylene chains dependent upon whether they are mono-, di- or tri-acid esters.

polyoxyethylene-polyoxypropylene block copolymers having formula:

$$HO(CH_2CH_2O)_a(CH(CH_3)\ CH_2O)_b(CH_2CH_2O)_cH$$

or $$HO(CH(CH_3)CH_2O)_d(CH_2CH_2O)_e(CH(CH_3)CH_2O)_fH$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R", a product of BASF Corporation.

Amine Oxides having Formula:

$$R^{12}R^{13}R^{14}N{=}O$$

wherein $R^{12}$, $R^{13}$ and $R^{14}$ are saturated aliphatic radicals or substituted saturated aliphatic radicals. Preferable amine oxides are those wherein $R^{12}$ is an alkyl chain of about 10 to about 20 carbon atoms and $R^{13}$ and $R^{14}$ are methyl or ethyl groups or both $R^{12}$ and $R^{13}$ are alkyl chains of about 6 to about 14 carbon atoms and $R^{14}$ is a methyl or ethyl group.

Amphoteric synthetic detergents can be broadly described as derivatives of aliphatic tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Alkyl Glycosides $$R^{15}O(R^{16}O)_n(Z^1)_p$$

wherein $R^{15}$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^{16}$ is a divalent hydrocarbon radical containing from 2 to about 4 carbon atoms such as ethylene, propylene or butylene (most preferably the unit $(R^{16}O)_n$ represents repeating units of ethylene oxide, propylene oxide and/or random or block combinations thereof); n is a number having an average value of from 0 to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Examples of commercially available materials from Henkel Kommanditgesellschaft Aktien of Dusseldorf, Germany include APG® 300, 325 and 350 with $R^{15}$ being $C_9$–$C_{11}$, n is 0 and p is 1.3, 1.6 and 1.8–2.2 respectively; APG® 500 and 550 with $R^{15}$ is $C_{12}$–$C_{13}$, n is 0 and p is 1.3 and 1.8–2.2, respectively; and APG® 600 with $R^{15}$being $C_{12}$–$C_{14}$, n is 0 and p is 1.3.

While esters of glucose are contemplated especially, it is envisaged that corresponding materials based on other reducing sugars, such as galactose and mannose are also suitable.

Particularly preferred nonionic surfactants are polyoxyethylene and polyoxypropylene condensates of linear aliphatic alcohols.

The preferred range of surfactant is from about 0.5 to about 30% by wt., more preferably from about 0.5 to about 15% by wt of the composition.

Sequestrants

The compositions herein may also optionally contain one or more transition metal chelating agents. Such chelating agents can be selected from the group consisting of amino carboxylates, amino phosphonates, polyfunctionally-substituted aromatic chelating agents and mixtures therein. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetraacetates, N-hydroxyethylethylenediaminetriacetates, nitrilotriacetates, ethylenediamine tetraproprionates, triethylenetetraamine-hexaacetates, diethylenetriaminepentaacetates, ethylenediamine disuccinate, and ethanoldiglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

If utilized, these chelating agents will generally comprise from about 0.1% to about 10% by weight of the detergent compositions herein. More preferably, if utilized, the chelating agents will comprise from about 0.1% to about 5.0% by weight of such composition.

Tablet Additives

Tablets frequently require adjuncts, called excipients. These have many uses, for example, in binding the ingredients together in the tablet, in aiding disintegration of the tablet in the wash and to facilitate manufacture of the tablet. The key ingredients in this category are binders, disintegrants and lubricants. One important property of these tablet additives is that they be compatible with the active ingredients in the tablet. Often, a binder also performs the role of disintegrant and it is useful to consider these two functions together.

The purpose of the binder/disintegrant is to help hold the ingredients of the tablet together but still allow dissolution in the wash water. With certain ingredients, a binder is essential to allow formation of a tablet but, even when a tablet can be formed in the absence of the binder, incorporation of a binder allows use of lower compaction pressures which aids in the breakdown of the tablet in the wash liquor. Lower compaction pressures allow for higher throughput during processing of tablets while decreasing the probability of mechanical breakdown of parts due to high stress.

A number of binders and disintegrants are described in the literature (see, for example, "Pharmaceutical Dosage Forms: Volume 1", 1989, Marcel Dekker Inc., ISBN 0-8247-8044-2). Both natural polymeric materials and synthetic polymers are useful. These include starches, such as corn, maize, rice and potato starches and starch derivatives such as U-Sperse M® and U-Sperse® supplied by National Starch Primojel® carboxymethyl starch and sodium starch glycolate such as Explotab®, pregelatinized corn starches such as National® 1551 and Starch® 1500; celluloses and cellulose derivatives including sodium carboxymethyl cellulose such as Courlose® and Nymcel®, cross-linked sodium carboxymethyl cellulose such as Ac-Di-Sol® supplied by FMC Corp., microcrystalline cellulosic fibers such as Hanfloc®, microcrystalline cellulose such as Lattice® NT supplied by FMC Corp. and Avicel® PH supplied by FMC Corp. methylcellulose, ethylcellulose, hydroxypropylcellulose and hydroxypropylmethylcellulose. Other polymers useful as binders/disintegrants are polyvinylpyrrolidones such as Plasdone®, PVP® K-30 and PVP® K-60 all supplied by International Specialty Products; polyvinylpolypyrrolidones, a cross-linked homopolymer of N-vinyl-2-pyrrolidone such as Polyplasdone® XL supplied by International Specialty Products; polymethacrylates, polyvinyl alcohols and polyethylene glycols. Gums such as acacia, tragacanth, guar, locust bean and pectin, gelatin, sucrose and alginates are also useful as binders/disintegrants. Suitable inorganic materials include magnesium aluminum silicate such as Veegum® HV supplied by R. T. Vanderbilt Co. Inc., bentonite and montmorillonite such as Gelwhite® supplied by Southern Clay Products. Other suitable binders include monoglycerides such as Imwitor® 191 supplied by Huls America Inc., glyceryl stearates such as Imwitor® 900 supplied by Huls America Inc., and palm oil glycerides such as Inwitor® 940 supplied by Huls America Inc. Most preferred as binders/disintegrants are microcrystalline celluloses and polyethylene glycols. The most preferrred polyethylene glycols have a molecular weight from about 2,000 to about 15,000.

Another way of enhancing dissolution of a tablet in the wash water is to incorporate an effervescent system. This includes weak acids or acid salts such as citric acid, maleic acid, tartaric acid, sodium hydrogen phosphates, in combination with a basic ingredient that evolves carbon dioxide when interacting with this acid source. Examples include sodium and potassium carbonate and bicarbonate and sodium sesquicarbonate.

Other tablet additives commonly used are lubricants to aid the tabletting process, such as stearates, waxes, hydrogenated vegetable oils and polyethylene glycols and fillers such as sugars, sodium sulfate and sodium chloride.

Minor amounts of various other components may be present in the first layer of the tablet. These components include bleach scavengers including but not limited to sodium bisulfite, sodium perborate, reducing sugars, and short chain alcohols; enzyme stabilizing agents; soil suspending agents; antiredeposition agents; anti-corrosion agents, such as benzotriazole and its derivatives, isocyanuric acid described in Angevaare, U.S. Pat. No. 5,374,369; purine derivatives described in Angevaare, U.S. Pat. No. 5,468,410; 1,3-N azole compounds described in Gary, U.S. Pat. No. 5,480,576; ingredients to enhance decor care such as certain aluminum salts described in U.S. Ser. Nos. 08/444,502 and 08/444,503, colorants; perfumes; defoamers such as mono- and distearyl phosphate silicone oil, mineral oil and those described in Angevaare et al., U.S. Ser. No. 08/539,923 and other functional additives. All publications herein incorporated by reference.

Optionally the functional ingredients described above included in the first layer of a two layer tablet may also be delivered from multiple layers to enhance performance by controlling the release of the ingredients or to improve storage stability of mutually incompatible ingredients. Use of certain organic peracids such as phthalimidoperhexanoic acid is an example. For optimum bleaching, these are incorporated into a second layer along with a source of acidity to cause a drop in pH during the main cycle. Co-pending applications Nicholson et al.; 08/780,062 and Nicholson. et al.; U.S. Ser. No. 08/780,063 describe the systems for the ingredients delivered to the main wash including pre-formed peracids, a per acid precursor and source of hydrogen peroxide, and an oxygen bleach system plus an inorganic or organic catalyst.

Second Tablet Layer

A second tablet layer of a two layer tablet or the third layer of a three-layer tablet comprises a continuous medium that has a minimum melting point of about 55° C. and a maximum melting point of about 70° C. with a maximum solids content of about 10% at 70° C., which acts as a carrier for a source of acidity and optionally, a surfactant and an anti-scalant, releasing these ingredients in the rinse cycle.

Materials of the Continuous Medium

Materials suitable for use as the continuous medium of the last layer of the tablet must have a number of characteristics. Thus, the material must be chemically compatible with ingredients to be incorporated into the layer, must be compressible into a tablet layer and must have a suitable release profile, especially an appropriate melting point range. The preferred melting point range is from about 55° C. to about 70° C. with the materials having a maximum solids content of about 10% at 70° C. Paraffin waxes, microcrystalline waxes and natural waxes give good results. Example of paraffin waxes, all of which have close to 0% solids content at 70° C., include those supplied by Moore & Munger such as fully refined paraffin waxes R-6240, R-4041, R-9645, R-1053, R-9547, R-3048, slack waxes S-2040, S-7245, S-3644, S-7246, scale wax W-5940; Boler® 1318 from IGI Boler; S. P.173, S. P.673 from Strahl & Pitsch; 140/145AMP, 150/155AMP from Frank B. Ross, Altafin® 140/145 from Astor-Durachem. All these paraffin waxes have a melting point between 60° C. and 65° C. Suitable microcrystalline waxes include White 1329/1 and White 1365 from Frank B. Ross, both with a melting point of 60°–66° C., Multiwax® 110X (melting point 55°–60° C.) from Witco and Ultraflex® (melting point 65° C. from Petrolite). Other suitable materials for the continuous medium are Beeswax such as White 145, White 776, White 1623 and Lillywhite 628/5 (melting point 62°–65° C.) all from Frank B. Ross and Ozokerite Wax White 64W (melting point 63°–67° C.) from Frank B. Ross.

Polyvinyl ethers of molecular formula [CxH2xO]y are useful as a material of the continuous medium. Other options for the material of the continous medium are fatty acids. Stearic, palmitic and mixtures thereof are examples of suitable fatty acids. These mixtures also contain some myristic acid. Some examples are Emersol® 153 (95% stearic acid, melting point 67°–69° C.), Emersol® 150 (80% stearic acid, melting point 64°–65° C.), Emery® 420 (70% stearic acid, melting point 57°–63° C.), Emery(® 522 (55% stearic acid, melting point 56°–60° C.). Fatty acid derivatives such as the alkonamides and glyceryl esters, mono-, di- and triglycerides, alkali metal salts of fatty acids and fatty alkyl phosphate esters are also useful. Lime soap dispersants and antifoaming agents may be required if fatty acids or their derivatives are used for the continuous medium. Polyethylene waxes of suitable melting point are also useful, especially when mixed with suitable waxes. Other suitable materials are sorbitan esters, polyoxyethylene sorbitan fatty acid esters, polyethylene glycols, polyvinyl alcohols, ethylene-vinylacetate, styrene-vinylacetate and ethylene-maleic anhydride copolymers and partially esterified polymers of maleic anhydride, acrylic acid or methacrylic acid.

Most preferred are paraffin waxes either alone or as a mixture with polyvinyl ethers.

Inclusion of surfactant into the final layer is desirable to ensure good dispersion of the continuous medium of the second layer into the wash water. Preferred surfactants are nonionics produced by the condensation of alkylene oxide groups with an organic hydrophobic material which may be aliphatic or alkyl aromatic in nature. Especially preferred surfactant are described in WO 94/22800 of which those that have a melting point above 20° C. are most preferred.

Sources of Acidity

The amount of acidity incorporated should be such that the pH of the rinse water after release of the acidity should be below about pH 9, preferably below about pH 8.5 and most preferably below about 6.5 to about pH 8. The source of acidity can be added directly, as is, to the continuous medium of the last layer of the tablet to be released into the rinse or be granulated with a binder and optionally with a surfactant for rapid dissolution prior to mixing with the continuous medium. The acidity granules should be between 100 and 2,000 microns and size. An alternative method of incorporating the acidity source is to coat the acidity granule with the continuous medium of the second layer in, for instance, a fluid bed, pan coater or rolling drum to produce encapsulates which may be directly used to form the second layer. Particularly preferred methods of producing the encapsulates, optionally with a surfactant for the rapid dissolution, are described in Nicholson, U.S. Pat. No. 5,480,577 herein incorporated by reference.

A range of acidity sources are suitable for the invention. It is preferable that the source of acidity be solid at room temperature. Mono-, di- and polycarboxylicacids are especially useful sources of acidity including lactic acid, glycolic acid, adipic acid, fumaric acid, maleic acid, malic acid, succinic acid, tartaric acid, malonic acid, tartronic acid, glutaric acid, gluconic acid, ascorbic acid, citric acid. Preferred inorganic sources of acidity include boric acid and the alkali metal and alkali earth metal salts of bicarbonate, hydrogen sulfate and hydrogen phosphate. Organo phosphonic acids, such as 1-hydroxy ethane 1,1-diphosphonic acid or amino polymethylene phosphonic acids, are also useful. Most preferred is citric acid.

Anti-Scalants

Scale formation on dishes and machine parts can be a significant problem. It can arise from a number of sources but, primarily it results from precipitation of either alkali earth metal carbonate, phosphates and silicates. Calcium carbonate and phosphates are the most significant problem. To reduce this problem, ingredients to minimize scale formation can be incorporated into the composition. These include polyacrylates of molecular weight from 1,000 to 400,000 examples of which are supplied by Rohm & Haas, BASF and Alco Corp. and polymers based on acrylic acid combined with other moieties. These include acrylic acid combined with maleic acid, such as Sokalan CP5 supplied by BASF or Acusol® 479N supplied by Rohm & Haas; with vinyl pyrrolidone such as Acrylidone® supplied by ISP; with methacrylic acid such as Colloid® 226/35 supplied by Rhone-Poulenc; with phosphonate such as Casi® 773 supplied by Buckman Laboratories; with maleic acid and vinyl acetate such as polymers supplied by Huls; with acrylamide; with sulfophenyl methallyl ether such as Aquatreat® AR 540 supplied by Alco; with 2-acrylamido-2-methylpropane sulfonic acid such as Acumer® 3100 supplied by Rohm & Haas; with sulfonic acid such as K-775 supplied by Goodrich; with sulfonic acid and sodium styrene sulfonatesuch as K-798 supplied by Goodrich; with methyl methacrylic acid, sodium methallyl sulfonate and sulfophenyl methallyl ether such as Alcoperse® 240 supplied by Alco; polymaleates such as Belclene® 200 supplied by FMC; polymethacrylates such as Tamol® 850 from Rohm & Haas; polyaspartates; ethylenediamine disuccinate; organo polyphosphonic acids and their salts such as the sodium salts of aminotri(methylenephosphonic acid) and ethane 1-hydroxy-1,1-diphosphonic acid. The anti-scalant, if present, is included in the composition from about 0.05% to about 10% by weight, preferably from 0.1% to about 5% by weight, most preferably from about 0.5% to about 5% by weight.

For optimum performance of the tablet, it is preferable that during the wash process, essentially none of the main wash ingredients should remain undissolved or undispersed by the end of the main wash cycle, irrespective of the number of layers that are used to deliver the main wash ingredients. In contrast, regarding the second layer of a two-layer tablet or third layer of a three-layer tablet, that is the layer that contains the ingredients to be delivered to the rinse, a maximum of about 50%, and preferably a maximum of about 25% of the ingredients in this layer should be delivered into the main wash and a minimum of at least 25% and preferably a minumum of at least 50% should be delivered into the final rinse.

Processing of Tablets

The ingredients that are intended for delivery into the main wash are mixed, transferred to a tablet die and compressed with a compaction pressure from about $5\times10^6$ kg/m$^2$ to about $3\times10^7$ kg/m$^2$.This procedure is described in copending application Nicholson et al.; UNUS No. 96-R362-EDG. If an organic per acid is utilized, the preferred method of processing these tablets is to include it in a separate layer. This is described in copending application Nicholson et al.; UNUS No. 96-R362-EDG.

Processing of the layer containing the ingredients to be released in the final rinse proceeds as follows. The ingredient that constitutes the continuous medium of the final layer is frequently a waxy solid and is often best handled by making flakes of this material and mixing these flakes with the the source of acidity, and optionally with a low foaming surfactant with a melting point above 15° C. and preferably above 25° C. and with anti-scaling agents. The source of acidity and anti-scaling agents can be pre-granulated either seprately or together with, optionally, a surfactant to enhance dissolution, to give granulates of size 100–2000 microns. The whole are compressed with a compaction pressure from about $1\times10^6$ kg/m$^2$ to about $3\times10^7$ kg/m$^2$.

It is advisable to add surfactant directly into this layer not only to deliver a sheeting action in the rinse, but also to ensure good dispersion of the material of the continuous medium into the wash water.

The following examples will serve to distinguish this invention from the prior art and illustrate its embodiment more fully. Unless otherwise indicated, all parts, percentages and proportions referred to are by weights.

EXAMPLE 1

Tablets (34 mm diameter, 18 mm thickness) were prepared according to the compositions shown in Table 1. The bleaching system contains a hydrogen peroxide source and a manganese catalyst. All values are in grams per ingredient and, unless specified, all anionic species are the sodium salts. The tablets were processed according to the specifications above with citric acid as a source of acidity mixed with flakes of a paraffin wax prior to tabletting. Tablet B lies within the scope of this invention and Tablet A lies outside.

TABLE 1

| | A | B | |
|---|---|---|---|
| Component | Layer 1 | Layer 1 | Layer 2 |
| Citrate | 7.0 | 7.0 | |
| Sokalan ® CP 5[1] | 0.7 | 0.7 | |
| Disilicate | 3.8 | 3.8 | |
| Sokalan ® PA 25[2] | 0.35 | 0.35 | |
| Carbonate | 1.20 | 1.20 | |
| Mn Catalyst[3] | 0.45 | 0.45 | |
| Perborate Monohydrate | 3.25 | 3.25 | |
| Protease[4] | 0.78 | 0.78 | |
| Amylase[5] | 0.35 | 0.35 | |
| Polyethylene Glycol (MW 4600) | 3.0 | 3.0 | |
| Citric Acid | | | 3.0 |
| Wax[6] | | | 2.0 |

[1]Acrylate/maleate copolymer ex. BASF
[2]Polyacrylate ex BASF

TABLE 1-continued

| Component | A Layer 1 | B Layer 1 | B Layer 2 |
|---|---|---|---|

[3]As described in U.S. Pat. No. 5,246,621.
[4]Purafect OxP ® ex Genencor
[5]Duramyl ® ex Novo
[6]IGI 1240 Paraffin wax, m.pt. 58° C., supplied by The International Group, Inc.

The tablets were evaluated in the E50 cycle of a Bosch dishwashing machine. The tablets were introduced into the machine via a basket hanging from the top rack. Glass tumblers were evaluated for filming using the visual scoring system where filming is rated from 0 (no film) to 5 (heavy film). The permanent wash water hardness was 300 ppm (4:1 calcium/magnesium expressed as calcium carbonate) and the temporary wash water hardness (bicarbonate) was 320 ppm. The glasses were washed up to 3 cycles.
The results of are summarized in Table 2.

TABLE 2

| Tablet | Filming on Glasses Run #1 | Run #2 | Run #3 |
|---|---|---|---|
| A | 1.9 | 2.0 | 2.5 |
| B | 1.8 | 1.9 | 1.7 |

The advantage of the technology of the current invention is clear. Tablets B, which is within the scope of this invention, controls build-up of scale better than Tablet A which is outside the scope of the invention.

EXAMPLE 2

Tablets (34 mm diameter, 18 mm thickness) were prepared according to the compositions shown in Table 3. The bleaching system is phthalimidoperhexanoic acid (PAP) and in order to deliver optimum performance from PAP, the tablets were prepared according to the composition and process in the co-pending application Nicholson et al.; U.S. Ser. No. 08/780,062. PAP is included in the tablet in a second layer, along with a source of acidity. Thus, this example of a tablet within the scope of the invention has three layers. All values in Table 3 are in grams per ingredient and, unless specified, all anionic species are the sodium salts. The tablets were processed according to the specifications above with citric acid as a source of acidity mixed with flakes of a paraffin wax prior to tablefting. Tablet D lies within the scope of this invention and Tablet C lies outside.

| Component | C Layer 1 | C Layer 2 | D Layer 1 | D Layer 2 | D Layer 3 |
|---|---|---|---|---|---|
| Citrate | 7.0 | | 7.0 | | |
| Sokalan ® CP 5[1] | 0.7 | | 0.7 | | |
| Disilicate | 3.8 | | 3.8 | | |
| Sokalan ® PA 25[2] | 0.35 | | 0.35 | | |
| Carbonate | 1.20 | | 1.20 | | |
| Protease[3] | 0.78 | | 0.78 | | |
| Amylase[4] | 0.35 | | 0.35 | | |
| Polyethylene Glycol (MW 4600) | 3.0 | | 3.0 | | |
| Citric Acid | | 1.9 | | 1.9 | |
| PAP | | 1.0 | | 1.0 | |

-continued

| Component | C Layer 1 | C Layer 2 | D Layer 1 | D Layer 2 | D Layer 3 |
|---|---|---|---|---|---|
| Wax[5] | | 2.0 | | 2.0 | |
| Citric Acid | | | | | 3.0 |
| Wax[6] | | | | | 2.0 |

[1]Acrylate/maleate copolymer ex. BASF
[2]Polyacrylate ex BASF
[3]Purafect OxP ® ex Genencor
[4]Duramyl ® ex Novo
[5]Boler ® 1397, m.pt. 42–60° C.
[6]IGI 1240 Paraffin Wax, m.pt. 58° C., supplied by The International Group, Inc.

The tablets were evaluated in the E50 cycle of a Bosch dishwashing machine. The tablets were introduced into the machine via a basket hanging from the top rack. Glass tumblers were evaluated for filming using the visual scoring system where filming is rated from 0 (no film) to 5 (heavy film). The permanent wash water hardness was 300 ppm (4:1 calcium/magnesium expressed as calcium carbonate) and the temporary wash water hardness (bicarbonate) was 320 ppm. The glasses were washed up to 3 cycles.
The results of are summarized in Table 4.

TABLE 4

| Table | Filming on Glasses Run #1 | Run #2 | Run #3 |
|---|---|---|---|
| C | 1.7 | 1.5 | 2.0 |
| D | 1.3 | 1.2 | 1.5 |

Tablets C and D differ from Tablets A and B in that a source of acidity is released into the main wash in order to allow optimum functionality of the PAP. A second effect of this acid release is that scale build-up is reduced. However, even under these circumstances, the advantages of the current invention, in which there is controlled release of acidity into the rinse, is still observed.

We claim:

1. A detergent composition in solid form useful for machine dishwashing comprising:

(a) a first layer comprising (i) an effective amount of an oxygen bleaching system to bleach soils from tableware washed in a machine dishwasher, the oxygen bleaching system selected from the group consisting of a peroxyqen bleach source, a peracid, a peracid precurser with a source of hydrogen peroxide, a bleach catalyst, a diacylperoxide and mixtures thereof, (ii) an effective amount of a buffering system to deliver a pH of about 8.5 to about 11 in wash water, selected from the group consisting of water soluble alkali metal carbonates, bicarbonates, sesquicarbonates, borates, silicates, layered silicates, metasilicates, phytic acid, borate, crystalline aluminosilicates, amorphous aluminosilicates and mixtures thereof, (iii) about 5 wt. % to about 90 wt. % of a builder selected from the group consisting of alkali metal pyrophosghates, orthophosphates, polyphosphates, alkali metal citrates, nitrilotriacetates, oxydisuccinates, polyphosphonates, acrylate/maleate copolymers, acrylate/maleate/vinylalcohol terpolymers and mixtures thereof, and (iv) 1 to about 5wt. % of an enzyme selected from the group consisting of proteases, amylases, and mixtures thereof, wherein the first layer dissolves to deliver a pH of about 8.5 to about 11 in the wash water; and (b) a second layer comprising (i) an effective amount of an acidity agent to provide a pH of rinse water after the release of the acidity agent below about pH 9, the acidity agent selected from a group consisting of a monocarboxylic acid, dicarboxylic acid, polycarboxylics acid, a boric acid, organo phosphonic acids, alkali metal and alkali earth metal salts of bicarbonate, hydrogen sulfate and hydrogen phosphate, and mixtures thereof, (ii) an effective amount of a material of a continuous medium to act as a carrier for the acidity agent and anti-scaling agent, the continuous medium having a melting point in the range of from about 55° C. to about 70° C., and selected from the group of materials consisting of paraffin waxes, microcrystalline waxes, natural waxes, polyvinyl ethers, long chain fatty acids, alkonamides, glyceryl esters, mono-, di-, and triglycerides, alkali metal salts of fatty acids and fatty alkyl phosphate esters, polyethylene waxes, sorbitan esters, polyoxyethylene sorbitan fatty acid esters, polyethylene glycols, polyvinyl alcohols, ethylene-vinylacetate,styrene-vinylacetate and ethylene-maleic anhydride copolymers, partially esterified polymers of maleic anhydride, acrylic acid or methacrylic acid, and mixtures thereof, and (iii) up to about 10% of an anti-scaling agent selected from a group consisting of polyacrylates having a molecular weight of from 1000 to about 400,000; acrylic acid/maleic acid; acrylic acid/vinyl pyrrolidone; acrylic acid/methacrylic acid; acrylic acid/phosphonate; acrylic acid/maleic acid/vinyl acetate; acrylic acid/acrylamide; acrylic acid/sulfophenyl methallyl ether; acrylic acid/2-acrylamido-2-methylpropane sulfonic acid; acrylic acid/sulfonic acid; acrylic acid/sulfonic acid/sodium styrene sulfonate; acrylic acid/methyl methacrylic acid/sodium methylallyl sulfonate/sulfoethyl methylallyl ether; polymaleate; polymethacrylate; polyaspartate; ethylenediamine disuccinate; organo Dolyphosphonic acid and salts thereof; and mixtures thereof, wherein the second layer dissolves in the wash water to deliver a pH of from about 6.5 to about 9.

2. The detergent composition according to claim 1 wherein the per acid precursor is selected from the group consisting of sodium p-benzoyloxybenzene sulfonate, N,N,N',N'-tetraacetylethylene diamine, sodium nonanoyloxybenzene sulfonate, choline sulfoethyl carbonate and mixtures thereof.

3. The detergent composition according to claim 1 wherein the first layer further comprises from about 0.5 to about 30% by wt. of a surfactant selected from the group consisting of anionic, nonionic, cationic, amphoteric, zwitteronic surfactants and mixtures thereof.

4. The detergent composition according to claim 1 wherein the solid form is a tablet.

5. The detergent composition according to claim 4 wherein the tablet has more than two layers.

6. A method for cleaning tableware in a machine dishwasher comprising the steps of a) dissolving a detergent composition in solid form in wash water, the composition comprising a first layer comprising (i) an effective amount of an oxygen bleaching system to bleach soils from tableware washed in a machine dishwasher, the oxygen bleaching system selected from the group consisting of a peroxygen bleach source, a per acid, a per acid precurser with a source of hydrogen peroxide, a bleach catalyst, a diacylperoxide and mixtures thereof, (ii) an effective amount of a buffering system to deliver a pH of about 8.5 to about 11 in the wash water, selected from the group consisting of water soluble alkali metal carbonates, bicarbonates, sesquicarbonates, borates, silicates, layered silicates, metasilicates, phytic acid, borate, crystalline aluminosilicates, amorphous aluminosilicates and mixtures thereof, (iii) about 5 wt. % to about 90 wt. % of a builder selected from the group consisting of alkali metal pyrophosphates, orthophosphates, polyphosphates, alkali metal citrates, nitrilotriacetates, oxydisuccinates, polyphosphonates, acrylate/maleate copolymers, acrylate/maleate/vinylalcohol terpolymers and mixtures thereof, and (iv) 1 to about 5wt. % of an enzyme selected from the group consisting of proteases, amylases, and mixtures thereof, wherein the first layer dissolves to deliver a pH of about 8.5 to about 11 in the wash water; and (b) a second layer comprising (i) an effective amount of an acidity agent to provide a pH of rinse water after the release of the acidity agent below about pH 9, the acidity agent selected from a group consisting of monocarboxylic acid, dicarboxylic acid, polycarboxylic acid, a boric acid, organo phosphonic acids, alkali metal and alkali earth metal salts of bicarbonate, hydrogen sulfate and hydrogen phosphate, , and mixtures thereof, (ii) an effective amount of a material of a continuous medium to act as a carrier for the acidity agent and anti-scaling agent, the continuous medium having a melting point in the range of from about 55° C. to about 70° C., and selected from the group of materials consisting of paraffin waxes, microcrystalline waxes, natural waxes, polyvinyl ethers, long chain fatty acids, alkonamides, alyceryl esters, mono-, di-, and triglycerides, alkali metal salts of fatty acids and fatty alkyl phosphate esters, polyethylene waxes, sorbitan esters, polyoxyethylene sorbitan fatty acid esters, polyethylene glycols, polyvinyl alcohols, ethylene-vinylacetate, styrene-vinylacetate and ethylene-maleic anhydride copolymers, partially esterified polymers of maleic anhydride, acrylic acid or methacrylic acid, and mixtures thereof, and (iii) up to about 10% of an anti-scaling agent selected from a group consisting of polyacrylates having a molecular weight of from 1000 to about 400,000; acrylic acid/maleic acid; acrylic acid/vinyl pyrrolidone; acrylic acid/methacrylic acid; acrylic acid/phosphonate; acrylic acid/maleic acid/vinyl acetate; acrylic acid/acrylamide; acrylic acid/sulfoethyl methylallyl ether; acrylic acid/2-acrylamido-2-methylpropane sulfonic acid; acrylic acid/sulfonic acid, acrylic acid/sulfonic acid/sodium styrene sulfonate; acrylic acid/methyl methacrylic acid/sodium methylallyl sulfonate/sulfoethyl methylallyl ether; polymaleate; polymethacrylate; polyaspartate; ethylenediamine disuccinate; organo polyphosphonic acid and salts thereof: and mixtures thereof, wherein the second layer dissolves in the wash water to deliver a pH of from about 6.5 to about 9; and b) applying the detergent composition to tableware to substantially clean the tableware.

7. The method according to claim 6 wherein the per acid precursor is selected from the group consisting of sodium p-benzoyloxybenzene sulfonate, N,N,N',N'-tetraacetylethylene diamine, sodium nonanoyloxybenzene sulfonate, chlorine sulfoethyl carbonate and mixtures thereof.

8. The method according to claim 6 wherein the first layer further comprises from about 0.5 to about 30% by wt. of a surfactant selected from the group consisting of anionic, nonionic, cationic, amphoteric, zwitteronic surfactant and mixtures thereof.

9. The method according to claim 6 wherein the solid form of the detergent composition is a tablet.

* * * * *